US007983574B2

(12) United States Patent
Kolb

(10) Patent No.: US 7,983,574 B2
(45) Date of Patent: Jul. 19, 2011

(54) ABNORMAL USAGE DETECTION

(75) Inventor: Kurt Robert Thor Kolb, Hillingdon (GB)

(73) Assignee: Xerox Corporation, Norwalk, CT (US)

( * ) Notice: Subject to any disclaimer, the term of this patent is extended or adjusted under 35 U.S.C. 154(b) by 628 days.

(21) Appl. No.: 11/775,548

(22) Filed: Jul. 10, 2007

(65) Prior Publication Data

US 2009/0016744 A1 Jan. 15, 2009

(51) Int. Cl.
*G03G 15/00* (2006.01)

(52) U.S. Cl. ..... 399/24; 399/27; 399/12

(58) Field of Classification Search ..... 399/24
See application file for complete search history.

(56) References Cited

U.S. PATENT DOCUMENTS 4,496,237 A 1/1985 Schron
5,636,032 A 6/1997 Springett
6,405,178 B1 6/2002 Manchala et al.
6,940,613 B1 9/2005 Beard et al.
7,009,719 B2 3/2006 Willis et al.
7,124,097 B2 10/2006 Claremont et al.
2002/0097444 A1* 7/2002 Shibata ..... 358/402
2004/0158661 A1* 8/2004 Mokuya ..... 710/72
2004/0184066 A1* 9/2004 Urabe ..... 358/1.14
2007/0147854 A1* 6/2007 Yamada ..... 399/12

* cited by examiner

*Primary Examiner* — David M Gray
*Assistant Examiner* — Roy Yi
(74) *Attorney, Agent, or Firm* — Oliff & Berridge, PLC

(57) ABSTRACT

A method and system compare actual consumable usage (e.g., toner usage) with expected consumable usage in a xerographic machine, such as a printer or copier. Expected toner usage may be predicted from pixel count (area coverage) and actual usage is obtained from monitoring of consumable usage, such as from toner dispense data or toner bottle replacements. If the actual toner usage differs significantly from the expected toner usage (e.g., ±40%), the system may take some action, such as scheduling of a service call. Early detection of abnormal consumable usage in a xerographic machine may allow early correction before any noticeable image defects occur, such as images that are too light or too dark.

18 Claims, 3 Drawing Sheets

ABNORMAL USAGE DETECTION

BACKGROUND

This disclosure generally relates to machines, such, as printers and copiers and specifically relates to maintenance and customer service.

Customer service for machines, such as printers and copiers typically occurs when customers report problems. Usually, customers report problems when the machine breaks down or when the machine has an externally observable symptom of a problem, such as printouts that are too dark or too light, leaking toner, jams, software faults, noises, and the like. As a result, machines that deliver good copies are seldom reported to customer service, even when machines may be using excessive amounts of consumable resources, such as toner.

SUMMARY

Upon reviewing maintenance data, it has recently become apparent that machines that use excessive amounts of consumable resources are likely to need repair. They are likely to need repair if only to reduce consumption of the consumable resource and reduce the cost of replacing the consumable resource too often when no service is requested for a machine excessively consuming a resource, the cost for running the machine is increased. For example, a machine with an average mean printing volume of 60,000 prints per month using 140% of the expected toner usage costs more per month more to run than one using the expected toner usage. Even if the extra cost is not a problem, abnormal usage may indicate that a machine is not operating optimally. For example, image may be too light, the triboelectric charge may be too high, the dispense motor may not be working, or there may not be sufficient power because a fuser element is not passing current. If service is not performed until an externally observable problem occurs, then when service is finally performed, productivity is likely to be disrupted. Thus, there is a need to draw attention to those machines that excessively consume resources in order to reduce costs and prevent later repairs that may disrupt productivity.

Exemplary embodiments are directed to systems and methods for detecting abnormal usage of consumables in a machine. Usage of a consumable and expected usage of the consumable can be determined and compared. An abnormal usage alert is communicated when the usage deviates from the expected usage. In exemplary embodiments, the method may include determining and comparing the usage and expected usage over a time frame and communicating the abnormal usage alert when the deviation meets a threshold. The methods may also include determining a ratio of the average consumable usage over the average consumable dispensed. A usage can be determined when the expected usage deviates from the ratio by a predetermined amount. The usage and expected usage may be determined as moving averages and the abnormal usage alert can be communicated when the moving average of usage deviates from the moving average of expected usage by a certain threshold.

Exemplary methods may also include updating the moving average of expected usage and updating the moving average of usage. In accordance with various aspect of the disclosure, the abnormal usage alert includes placing a service order. The method may include building a model of usage and determining the expected usage from the model. If the consumable is toner, the expected usage may be determined indirectly, such as by using pixel count or area coverage and usage may be determined, for example, by monitoring a dispense time.

Exemplary systems include a system for detecting abnormal usage of consumables in a xerographic machine. The system may include a xerographic module, a xerographic monitor, and an abnormal usage alerting mechanism. The xerographic module creates images. The xerographic monitor includes a processor and a storage device. The processor includes means for determining usage of a consumable over a time frame, means for determining an expected usage of the consumable over the time frame, and means for comparing the usage of the consumable to the expected usage over the time frame. Some examples of consumables include toner, color ink, marking materials, power draw, paper and customer replaceable units. The processor may also build a model of actual usage that may be used to predict expected usage.

The abnormal usage alerting mechanism, which is connected to the xerographic monitor, is activated when the usage deviates from the expected usage by a predetermined threshold. Exemplary systems may also include a display for displaying the abnormal usage alert. The abnormal usage alerting mechanism may be activated when fuser power deviates from the expected usage by a threshold. Alternatively, the abnormal usage alerting mechanism may be activated when a moving average of actual usage deviates from the expected usage. The moving average may be determined and updated for both expected and actual usage. A ratio may be calculated to detect abnormal usage. For example, a ratio of the average consumable usage over the average consumable usage may be computed. The ratio may be used to determine when usage deviates from the expected usage by comparing it to a predetermined amount.

The system may also include a fuser module and a fuser monitor in the fuser module. The fuser module determines the fuser usage as a consumable over a time frame and compares the fuser usage of the consumable to expected usage over the same time flame. The fuser monitor include a fuser processor and a f-user storage device.

EMBODIMENTS

Figure 1:
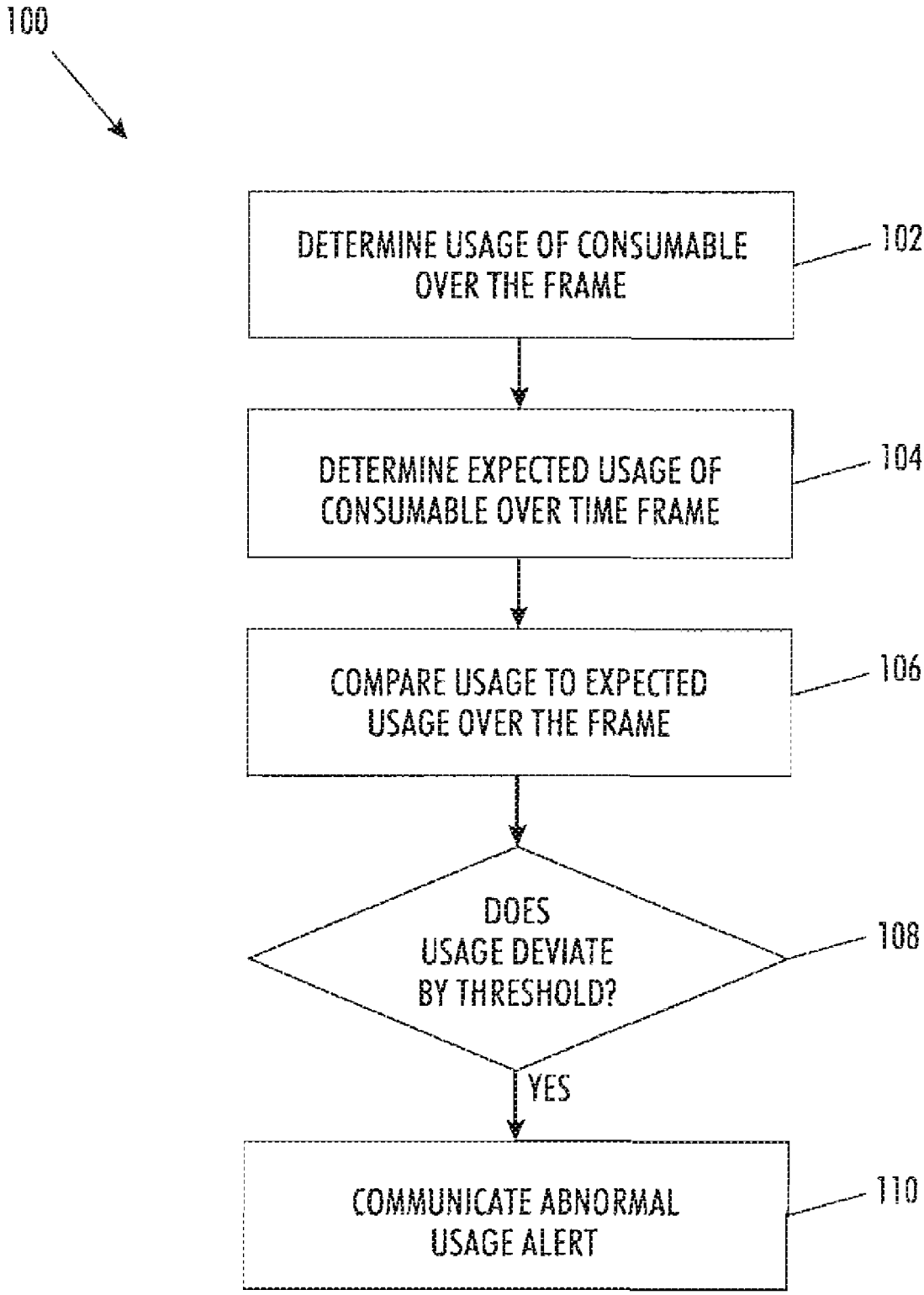
FIG. 1 illustrates an exemplary method for abnormal usage detection.
Figure 3:
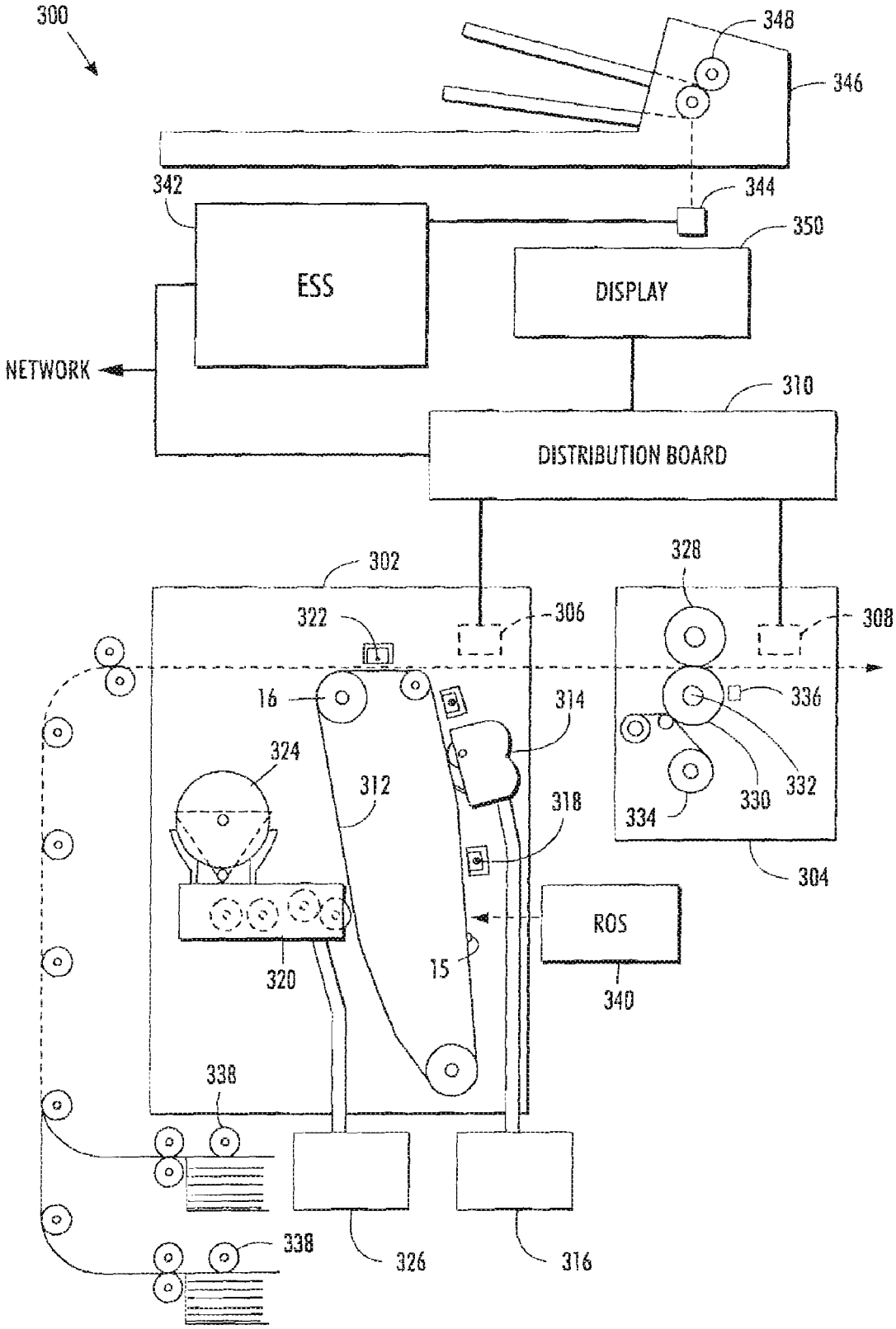
FIG. 3 illustrates a simplified, partially elevational and partially schematic view of an exemplary printing machine to which the detection method can be applied.

FIG. 1 illustrates an exemplary method for abnormal usage detection 100. This exemplar, method detects abnormal usage of consumables in a machine, such as a printer or copier (as shown in FIG. 3). Abnormal usage is any usage that deviates from the expected or normal usage based on past history, empirical data and the like. Consumable resources may include various consumables on such a machine, including color ink, or other marking materials, power draw, paper, customer replaceable units, etc. As shown in FIG. 1, usage of a consumable is determined at step S102 over a time frame and expected usage of the consumable is determined over a specific time frame at step S104 and compared at step S106. An abnormal usage alert is communicated at step S110 when the usage deviates from the expected usage by a predetermined threshold as determined in step S108.

Figure 2:
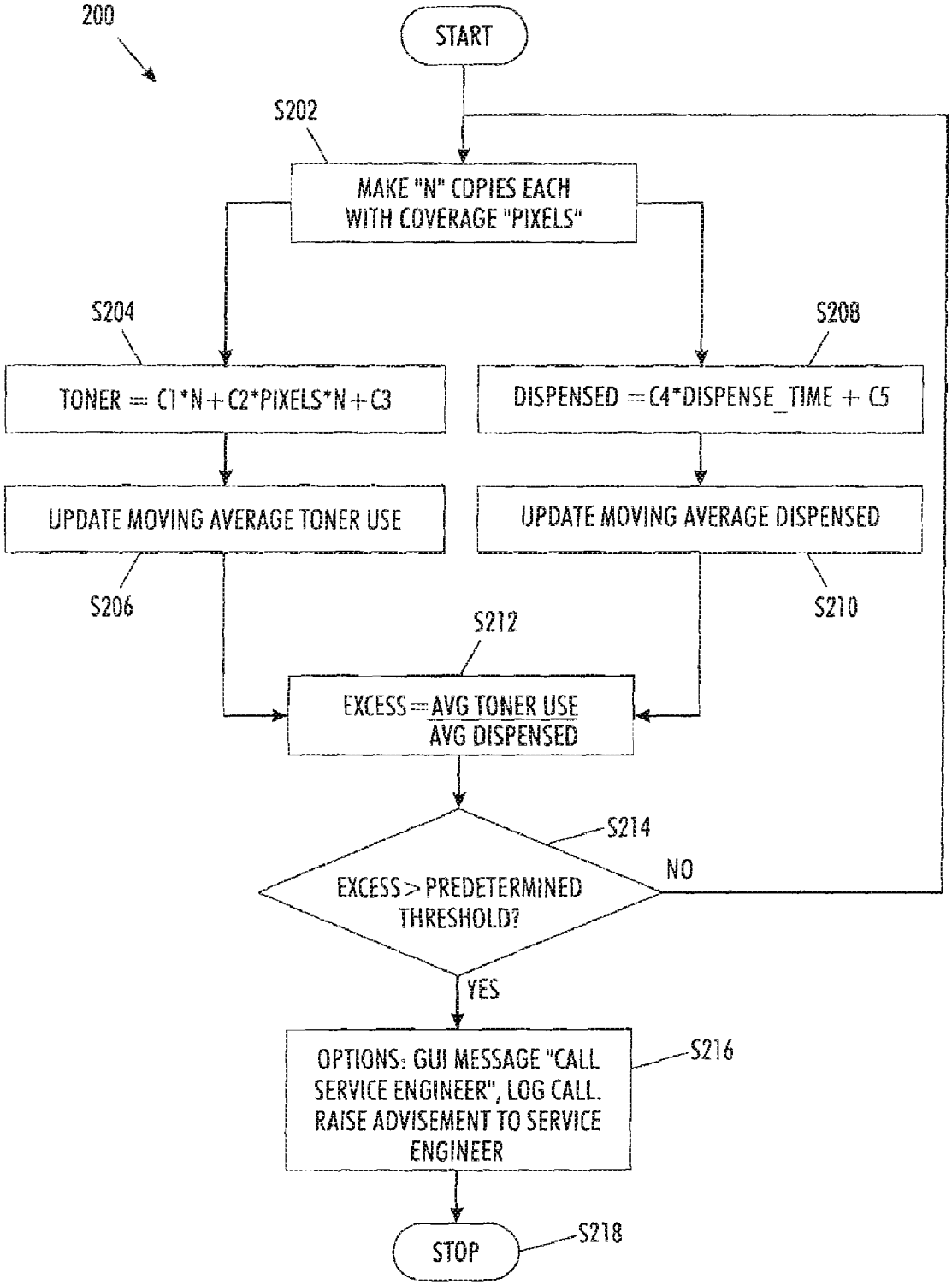
FIG. 2 illustrates an exemplary method for excess usage detection.

FIG. 2 illustrates an exemplary method 200 for detecting excess usage of consumable resources (consumables) in machines, such as printers and copiers including the xerographic machine shown in FIG. 3. Consumable resources will be described with reference to an exemplary consumable, toner, but may include various other consumables on such a machine, including color ink, or other marking materials, power draw, paper, customer replaceable units, etc.

Excess usage of consumable resources may indicate preventable problems. For example, although comparable products may have nominal tolerance differences, excess usage of toner may identify dispensing problems, excess power draw may identify a sign of a short or leaking circuits, excess usage of paper may identify multifeeds or other handling problems, and excess usage of customer replaceable units may identify units that may expire early and need replacement. Usage of a consumable resource in a machine, such as a copier or printer, may be monitored, modeled and predicted. Such monitoring, modeling, and prediction may be implemented wholly or partially in software and/or performed manually. What constitutes excessive usage may be quantified based on several subjective criteria and considerations, but in general can be any usage greater than a predicted usage or a predetermined percentage of predicted usage.

Referring to FIG. 2, at step S202, a number, N, of copies (or printouts, scans, etc.) are made, each with an area coverage stored in a variable called Pixels. The number, N may be any of the following: a predetermined number greater than zero, a dynamically determined number, the number of sheets in the last or current job or the like.

Area coverage is related to picture elements called pixels. Each page of the output consists of a two-dimensional grid of pixels, in which there are x pixels in width and y pixels in length of the page. Area coverage is the percentage of the total pixels for the page that are to be printed. For example, a 5% coverage means that 5% of the surface area of the page is being printed.

Each pixel in an image requires a fairly constant specific quantity of marking material (e.g., toner or ink) to be rendered (e.g., printed or copied). This is generally true, even when resolution enhancement or other print quality improvement processing is preformed. This quantity of marking material required may vary depending on specific marking material or machine characteristics. However, by counting each pixel in an image to be rendered (i.e., non-white space) and then multiplying the pixel count by the quantity of marking material required to mark each pixel, the usage of marking material for each page may be measured. Measured usage data may then be stored, monitored and predicted. Accordingly, the pixel count for the page divided by the total number of possible pixels in the page yields the area coverage.

Pixel counting may be done by, for example, monitoring the firing signal sequence of the optical raster output scanner (ROS) or the marking engine. Alternatively, the pixel count of the page as calculated or counted by the image processor may be used, because images to be marked typically have an associated pixel count implemented in software. A marking material usage circuit may be provided with a counter or small memory to store the accumulated used marking material by, for example, the current toner or ink cartridge. The average page coverage for a particular toner or ink cartridge is commonly calculated during the design of the cartridge. Given the page size and resolution, such a circuit may calculate the number of pixels per page. For example, given an 8.5×11" page and a 400 dots per inch resolution, the number of pixels per page is 15,000,000. Five percent coverage of such a page would mean that 750,000 pixels would be rendered and counted. The area coverage of a page, the average area coverage of a job, and the average area coverage to date for a machine or particular marking material (e.g., toner or ink cartridge) may be used to predict expected marking material usage.

Returning to step S202 in FIG. 2, a number, N, of copies are made on a machine and the coverage for those copies is stored in variable Pixels. After the N copies are made, the following sample calculations are performed in this example, where c1, c2, c3, c4, and c5 are constants.

$$\text{Toner}=c1*N+c2*\text{Pixels}*N+c3;\ \text{and}$$

$$\text{Dispensed}=c4*\text{dispense_time}+c5.$$

At step S204, the predicted toner usage (Toner) is calculated based on the number, N, of copies. At step S206, the pixel area coverage (Pixels) at step S204 and the moving average predicted toner usage is updated with the predicted toner usage (Toner). The actual toner usage (i.e., dispensed) is calculated at step S208 based on data monitored by the machine, such as the time spent dispensing toner to print the number, N, of copies. The moving average actual toner usage is updated at step S210 with the actual toner usage calculated at step S208. The moving averages of predicted toner usage and actual toner usage are calculated for a fixed recent period of time, while the predicted toner usage and actual toner usage are calculated for the number. N, of copies. In these calculations, the constants (i.e., c1, c2, c3, c4, c5) may vary, depending on testing data, machine specifications and designs, reliability data maintenance data and the like.

In step S212 of FIG. 1, excess usage is defined as the ratio (average toner usage/average dispensed), a predetermined threshold. However, excess usage may be defined in many ways, depending on the consumable resource being measured, how the excess usage data will be used, testing data, machine specifications, reliability data, maintenance data and the like. Excess usage may also be defined dynamically, i.e., calculated differently depending on various factors, as opposed to the static definition in step S212 of FIG. 2. The excess usage ratio is calculated at step S212 repeatedly, e.g., for every number, N, of copies made, and, if excess usage is detected, a communication may be made at step S216. For example, N may be the number of continuous page in a job.

The communication may be many different kinds of communication, such as a message displayed on a graphical user interface on the machine, a stored log, a communication over a channel to a service center, a call to a service engineer and the like. Such a communication may alert a customer or service engineer of potential problems due to excess usage of consumables, such as toner, that may not otherwise be noticeable until the problems are chronic, such as leaking toner or black images. As a result of the communication, testing may be performed for various machines to determine the root causes of common maintenance problems having to do with excess usage of consumables in order to detect them earlier and avoid larger, more expensive maintenance problems later. Other actions in place of or in addition to sending a communication may also be performed, such as switching to a backup part or placing an order for maintenance or a replacement part.

One exemplary embodiment of a method for detecting excess usage of consumables in a machine includes monitoring a cumulative average use of one or more consumable or a moving average use of the consumable. The cumulative average use is compared to an expected use of the consumable over the same time frame. If the cost of excess usage is equal to or exceeds the cost of a service call, then it may be costeffective for a message to be raised to call a service engineer. Cost benefits may be calculated and displayed in order to provide information for the customer to make a decision regarding service.

One kind of consumable that may be monitored for excess usage is toner usage. Various other calculations may be used for other consumables according to the aspects of those consumables that may be measured, monitored, and predicted in the case of toner usage, toner use nay be predicted from the area coverage for each image rendered and from other information specific to the machine. A constant amount may be considered for background toner. Various variables and parameters may be stored in a memory in the machine or a connected processor and storage device in order to monitor, predict or calculate usage. Exemplary embodiments of a method of detecting excess usage of consumables may be stored in memory as instructions for a computer program product. A model of toner usage on particular machines may be built and used to predict toner usage for other machines. The specifics for each machine type may differ and may be determined empirically.

Many potential problems, such as contamination, leakage, low triboelectric charge and excess development may lead to toner usage that is greater than predicted. The actual toner usage may be calculated from the dispense motor rate and run on. Actual toner usage may be verified by collected data, such as toner bottle replacement statistics. By considering the predicted and actual toner usage over a suitably long moving average (e.g., 5,000 prints) excess usage may be defined, for example, as using about 140% of the predicted usage or some other excess usage factor. The excess usage factor may represent the confidence in the mean and distribution for normal machines. The excess usage factor may take into account the cost of a service call for the service engineer to check for toner contamination in the machine, dark copies or other problems related to excess usage of consumables. In addition, the service engineer may test whether the dispense motor is working correctly. The ratio of toner use to dispensed allows tracking of variable elements of the equation.

If a customer fails to request service for a machine excessively using a consumable, it can be costly. Thus, alerting a customer to excess usage may reduce operating costs. For example, one machine with a suggested average mean printing volume of 60,000 prints/month using 140% of the expected toner costs more per month to run than one using 100% of the expected toner. Not only does this result in unnecessary expense, but the excess toner may cause future problems such as dark copies or a toner mess in the machine occur, which may disrupt productivity. Exemplary embodiments draw attention to machines that are consuming resources excessively but otherwise appear healthy. Any consumable resource may be monitored, modeled and/or predicted. Resulting environmental benefits (e.g., efficient recycling of marking materials, such as toner bottles) and cost savings may be attractive to customers.

Exemplary embodiments of the method for detecting excess usage of consumables may be implemented using the methods and systems of, for example, U.S. Pat. Nos. 5,636,032 and 6,940,613. Exemplary embodiments may also be implemented using other methods and systems, past and future.

U.S. Pat. No. 5,636,032, which is hereby incorporated by reference in its entirety, discloses a method and system for informing a user about characteristics of a marking material cartridge in a printing system. The system calculates a number of pixels being rendered in a present job and calculates an amount of marking material used to render the present job. The system also calculates a total area coverage to date for the marking material cartridge. From this information, an expected number of pages that the marking material cartridge can render is determined and displayed. The system determines a date when marking material in the marking material cartridge will be depleted and displays the date. The system also calculates an average coverage amount for a page being presently rendered. It can also calculate per page costs of the page currently being printed, and the pages printed to date. These and other calculations may be used in exemplary embodiments of a method of detecting excess usage of consumables. Additionally, the cost benefits of draft or other reduced print quality modes can be calculated and displayed. The method and system is equally applicable to black and white or color printing.

U.S. Pat. No. 6,940,613, which is hereby incorporated by reference in its entirety, discloses an electrophotographic printing or copying machine that includes a functional module which can be readily removed and replaced by service personnel. The module includes a monitor in the form of an electronically-readable memory, which includes information about how the particular module is to be operated. A distribution board electronically accesses the memories within the monitors and reads information from the monitors, such as how much voltage to supply to different components within each module. The distribution board can also update the number of prints made with each module, and maintain this count within the monitors.

FIG. 3 illustrates a simplified, partially elevational and partially schematic, view of a machine 300, which is described in U.S. Pat. No. 6,940,613. Exemplary embodiments of a method for detecting excess usage of consumables may be performed in conjunction with the machine 300 of FIG. 3 or other machines, such as other printers, copiers, facsimile machines or multifunction machines.

The machine 300 includes one or more replaceable modules, such as a xerographic module 302 and a fuser module 304. Each of the replaceable modules, xerographic module 302 and the fuser module 304, include a monitor, i.e., a xerographic module monitor 306 and a fuser module monitor 308, respectively. Replaceable modules may include processors and storage units. In general, each replaceable module in a machine includes a monitor for storing information about operating the module, such as how much voltage to supply to different components in each module. Xerographic module monitor 306 and fuser module monitor 308 and/or other monitors may be used to monitor, collect and calculate data (e.g., area coverage) for use in the exemplary embodiments of the method for detecting excess usage of consumables.

The monitors, e.g., xerographic module monitor 306 and the fuser module monitor 308, are connected to a distribution board 310. The distribution board 310 electronically accesses the storage units of the modules (e.g., the fuser module 304) to read information. The distribution board 310 updates a count of prints made with each module and maintains the count of prints within the monitors. The distribution board 310 may be used in the exemplary embodiments of the method for detecting excess usage of consumables to update, for example, moving average toner use and average dispensed.

The xerographic module 302 includes various elements for creating images in an electrophotographic process. In the electrophotographic process, images are created on the surface of a rotating photoreceptor 312, which is mounted on a set of rollers, as shown. The photoreceptor 312 has the following elements disposed at various points around its circumference: a cleaning device 314 that empties into a toner reclaim bottle 316, a charging corotron 318, a developer unit 320, and a transfer corotron 322. The charging corotron 318 creates an electrostatic latent image on the surface of the photoreceptor corresponding to a desired image.

During the electrophotographic process, the latent image is developed by the developer unit 320. The developer unit 320 includes a housing including a supply of developer (e.g., toner and carrier particles). When the developer comes into contact with the latent image, a toner image is created. Color-capable machines may have multiple developer units 320, each developing the photoreceptor 312 with a different color toner. The toner or an admixture of carrier particles and continuously may be contained in a toner bottle 324. Alternatively, toner or developer may be selectably added into a main body of the developer unit 320. Any excess developer is accepted by a developer receptacle 326 directly from the housing of the development unit 326. The developer receptacle 326 is distinguished from the toner reclaim bottle 316, which reclaims untransferred toner from the cleaning device 314. Thus, there are two separate receptacles for used and excess developer and toner.

The other replaceable module in machine 300, the fuser module 304, fuses the toner image after it has been electrostatically transferred to a sheet of media (e.g., plain paper) by the xerographic module 302. The fuser module 304 includes a pressure roll 328, a heat roll 330(, and a web supply 334. The pressure roll 328 applies pressure to the sheet on the paper path (shown by a dashed line) during the fusing. The heat roll 330 includes a heat element 332 at its core. The web supply 334 provides a release agent to the outer surface of heat roll 330 so that paper passing between the heat roll 330 and the pressure roll 328 does not stick to the heat roll 330. The fuser module 304 also includes a thermistor 336 for monitoring the temperature of a relevant portion of the fuser module 304. A nip is formed between the pressure roll 328 and the heat roll 330.

The sheets of media (e.g., plain paper) for receiving printed images are retained in stacks. Sheets are drawn from the stacks, typically one sheet at a time, by feed rolls 338. To print an image, a motor (not shown) activates one of the feed rolls 338, depending on what type of sheet is desired, and the drawn sheet is taken from the stack and moved through the paper path (shown by a (lashed line) where it eventually comes into contact with the photoreceptor 312 in the xerographic module 302. At the transfer corotron 322, the sheet receives an un fused image and then passes further along the paper path through the nip formed between the pressure roll 328 and the heat roll 330. The fuser module 304 thus causes the toner image to be permanently fixed to the sheet.

The latent images are created by selectably discharging pixel-sized areas on the surface of photoreceptor 31I, after the surface is charged by corotron 318. Typically, this selective discharging is performed by a raster output scanner (ROS) 340, which includes a modulating laser that reflects a beam off a rotating reflective polygon. Image data for the ROS 340 is generated by an electronic subsystem (ESS) 342. The ESS 342 may receive original image data from many sources, including a photosensor bar 344. The photosensor bar 344 typically includes a linear array of pixel-sized photosensors, on which a sequence of small areas on an original hardcopy image are focused. The photosensors in the array convert the dark and light reflected areas of the original image into electrical signals, which may be compiled and retained by the ESS 342, ultimately for reproduction through the ROS 340.

When the machine 300 of FIG. 3 is in digital copier mode, an original document handler 346 presents the original document to the photosensor bar 344. A document handler 346 includes any number of rollers, nudgers and the like 348.

The distribution board 310 sends or receives messages through the same network channels as the ESS 342 or through a telephone or facsimile line. The distribution board 310 may display messages on a display 350, such as a touch screen disposed on the exterior of the machine 300. Exemplary embodiments of the method of detecting excess usage of consumables may communicate through the distribution board 310 when excess usage is detected.

Xerographic module monitor 306 and fuser module monitor 308 are specially-adapted memory devices associated with xerographic module 302 and fuser module 328, respectively. Xerographic module 302 and fuser module 328 are replaceable for servicing purposes. The replaceable unit monitors, xerographic module monitor 306 and fuser module monitor 308, store, read and update information about now the module is being used within the machine 300, such that use characteristics of the modules may be discovered. This information may be retained in the module, even if the module is removed from the machine. The monitors 306, 308 may include electrically erasable programmable read only memory (EEPROM), ROM, PROM or other kinds of storage devices. Each monitor 306, 308 is connected to the distribution board 310 through a bus architecture and may transmit and receive data over the bus.

Different types of data may be stored in the monitors 306, 308 to be stored, read and updated by the distribution board 310, including service plan, market region, maximum print volume, print count security, pixel usage, maximum pixel usage value, machine average daily print volume, and the like. Exemplary embodiments of the method of detecting excess usage of consumables may store additional data in the monitors 306, 308 or elsewhere. The machine 300 may display or communicate various messages, including the need to replace a module, prediction of when a module will need to be replaced, service plan information.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for detecting abnormal usage of consumables in a machine, comprising:

determining a moving average of usage of a consumable for a time frame;

determining a moving average of expected usage of the consumable for the time frame based on a pixel count;

comparing the moving average of usage to the moving average of expected usage to determine an excess usage; and communicating an abnormal usage alert requesting service when the excess usage deviates from an expected usage.

2. The method of claim 1, further comprising:

comparing a usage and an expected usage over the time frame; and communicating the abnormal usage alert when the usage over the time frame deviates from the expected usage over the time frame by a threshold.

3. The method of claim 1, further comprising:

determining a ratio of an average consumable usage over an average consumable dispensed; and determining that a usage deviates from the expected usage when the ratio deviates from a predetermined amount.

4. The method of claim 1, further comprising:

updating the moving average of expected usage; and updating the moving average of usage.

5. The method of claim 1, wherein the abnormal usage alert includes placing a service order.

6. The method of claim 3, further comprising:

building a model of usage; and predicting a usage of consumables for another machine based on the model of usage.

7. The method of claim 6, further comprising:

determining the expected usage from the model.

8. The method of claim 1, wherein the consumable is toner and the method further comprises:

determining a usage using a dispense time.

9. The method of claim 1, wherein the consumable is selected from: toner, color ink, marking materials, power draw, paper, and customer replaceable units.

10. The method of claim 9, wherein the consumable is selected depending on a job type.

11. A computer readable medium storing instructions for causing a computer to perform the method of claim 1.

12. A system for detecting abnormal usage of consumables in a xerographic machine, comprising:

a xerographic module for creating images;

a xerographic monitor including a processor and a storage device, the processor being configured to determine a moving average of usage of a consumable for a time frame, determine a moving average of expected usage of the consumable for the time frame based on a pixel count, and compare the moving average of usage to the moving average of expected usage; and an abnormal usage alerting mechanism configured to request service and is activated when the excess usage deviates from the expected usage, wherein the abnormal usage alerting mechanism is connected to the xerographic monitor.

13. The system of claim 12, further comprising:

a display for displaying an abnormal usage alert.

14. The system of claim 12, wherein the consumables are selected from: toner, color ink, marking materials, power draw, paper, and customer replaceable units.

15. The system of claim 12, further comprising:

a fuser module; and a fuser monitor in the fuser module including a fuser processor and a fuser storage device, the fuser module being configured to determine a fuser usage of the consumable, determine an expected fuser usage of the consumable, and compare the fuser usage to the expected fuser usage;

wherein the abnormal usage alerting mechanism is activated when the fuser usage deviates from the expected fuser usage.

16. The system of claim 12, wherein:

the fuser module is configured to determine a ratio of an average consumable usage over an average consumable dispensed and is configured to determine that a usage deviates from the expected usage when the ratio is greater than a predetermined amount.

17. The system of claim 12, further comprising:

a distribution board configured to update the moving average of expected usage and configured to update the moving average of usage.

18. The method of claim 1, wherein communicating the abnormal usage alert in the form of a graphical user interface on the machine, a stored log, a communication over a channel to a service center, or a call to a service engineer.

* * * * *